US010499697B1

(12) United States Patent
Posta

(10) Patent No.: US 10,499,697 B1
(45) Date of Patent: Dec. 10, 2019

(54) NECK WRAP TOWEL

(71) Applicant: Matthew Posta, N. Providence, RI (US)

(72) Inventor: Matthew Posta, N. Providence, RI (US)

( * ) Notice: Subject to any disclaimer, the term of this patent is extended or adjusted under 35 U.S.C. 154(b) by 293 days.

(21) Appl. No.: 15/641,364

(22) Filed: Jul. 5, 2017

(51) Int. Cl.

| | |
|---|---|
| ***A41D 23/00*** | (2006.01) |
| ***A41D 27/20*** | (2006.01) |
| ***A41D 27/24*** | (2006.01) |
| ***A41D 1/00*** | (2018.01) |
| ***A44B 13/00*** | (2006.01) |
| ***A44B 11/25*** | (2006.01) |

(52) U.S. Cl.
CPC ..... *A41D 23/00* (2013.01); *A41D 1/002* (2013.01); *A41D 27/201* (2013.01); *A41D 27/245* (2013.01); *A44B 11/25* (2013.01); *A44B 13/00* (2013.01); *A41D 2300/322* (2013.01); *A41D 2400/60* (2013.01)

(58) Field of Classification Search
CPC ..... A41D 23/00; A41D 1/002; A41D 27/201; A41D 27/245
USPC ..... 2/91, 94, 207
See application file for complete search history.

(56) References Cited

U.S. PATENT DOCUMENTS 2,870,448 A * 1/1959 Rosenthal ..... A41D 1/04 2/91
4,637,075 A * 1/1987 Ingrisano ..... A41D 13/0012 2/102
4,805,619 A 2/1989 Swearingen
5,014,359 A * 5/1991 Hanson ..... A41D 13/0012 2/102
5,072,456 A * 12/1991 Elin ..... A41D 13/0012 2/102
5,075,900 A * 12/1991 Chittenden ..... A41D 13/0012 2/102
5,101,515 A * 4/1992 Holt ..... A41D 13/0051 2/102
5,211,321 A * 5/1993 Rodriguez ..... A41D 13/0012 2/102
5,247,707 A * 9/1993 Parker ..... A41D 13/0012 2/102
5,265,782 A * 11/1993 McNamara ..... A41D 13/12 2/108
5,278,998 A * 1/1994 Book ..... A41D 13/0012 190/1
5,361,412 A * 11/1994 Perry ..... A41D 13/0012 2/102
5,617,582 A * 4/1997 Burwell ..... A41D 13/0012 2/102

(Continued)

FOREIGN PATENT DOCUMENTS

WO 2003071887 A1 9/2003

*Primary Examiner* — Gloria M Hale

(57) ABSTRACT

The neck wrap towel is a garment. The neck wrap towel is worn around the neck of a person. When worn normally, the neck wrap towel drapes over the anterior side of the person. The neck wrap towel is further fitted with a plurality of findings that are configured for use in travel or sporting activities. The neck wrap towel comprises a primary textile, a bottle pocket, a secure pocket, one or more fasteners, a loop and clip combination, and a light. The bottle pocket, a secure pocket, the one or more fasteners, the loop and clip combination, and the light are attached to the primary textile.

13 Claims, 4 Drawing Sheets

(56) References Cited

U.S. PATENT DOCUMENTS

| | | | | | |
|---|---|---|---|---|---|
| 5,815,834 | A | * | 10/1998 | Bronson | A41B 13/00 2/102 |
| 5,829,060 | A | * | 11/1998 | Falk | A41D 13/0012 2/102 |
| 5,909,802 | A | * | 6/1999 | Puco | A45F 3/04 2/102 |
| 5,960,471 | A | * | 10/1999 | Burton | A41B 13/103 2/48 |
| RE38,393 | E | * | 1/2004 | Bronson | A41B 13/00 2/102 |
| 6,718,554 | B1 | | 4/2004 | Langston | |
| D590,198 | S | | 4/2009 | Nostrant | |
| 2007/0033706 | A1 | * | 2/2007 | Kuhlmann | A41D 23/00 2/207 |
| 2008/0061091 | A1 | | 3/2008 | Maillard | |
| 2012/0151649 | A1 | | 6/2012 | Peterson | |
| 2012/0204323 | A1 | * | 8/2012 | Park | A41D 23/00 2/202 |
| 2014/0259334 | A1 | * | 9/2014 | Mitchell | A41D 23/00 2/461 |
| 2014/0366240 | A1 | * | 12/2014 | Roban | A41D 3/08 2/84 |
| 2015/0052661 | A1 | * | 2/2015 | Poznick | A42B 1/048 2/202 |
| 2015/0113699 | A1 | | 4/2015 | Ramon | |

* cited by examiner

NECK WRAP TOWEL

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of wearing apparel including outerwear and accessories, more specifically, a scarf.

SUMMARY OF INVENTION

The neck wrap towel is a garment. The neck wrap towel is worn around the neck of a person. When worn normally, the neck wrap towel drapes over the anterior side of the person. The neck wrap towel is further fitted with a plurality of findings that are configured for use in travel or sporting activities. The neck wrap towel comprises a primary textile, a bottle pocket, a secure pocket, one or more fasteners, a loop and clip combination, and a light. The bottle pocket, a secure pocket, the one or more fasteners, the loop and clip combination, and the light are attached to the primary textile.

These together with additional objects, features and advantages of the neck wrap towel will be readily apparent to those of ordinary skill in the art upon reading the following detailed description of the presently preferred, but nonetheless illustrative, embodiments when taken in conjunction with the accompanying drawings.

In this respect, before explaining the current embodiments of the neck wrap towel in detail, it is to be understood that the neck wrap towel is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the neck wrap towel.

It is therefore important that the claims be regarded as including such equivalent construction insofar as they do not depart from the spirit and scope of the neck wrap towel. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
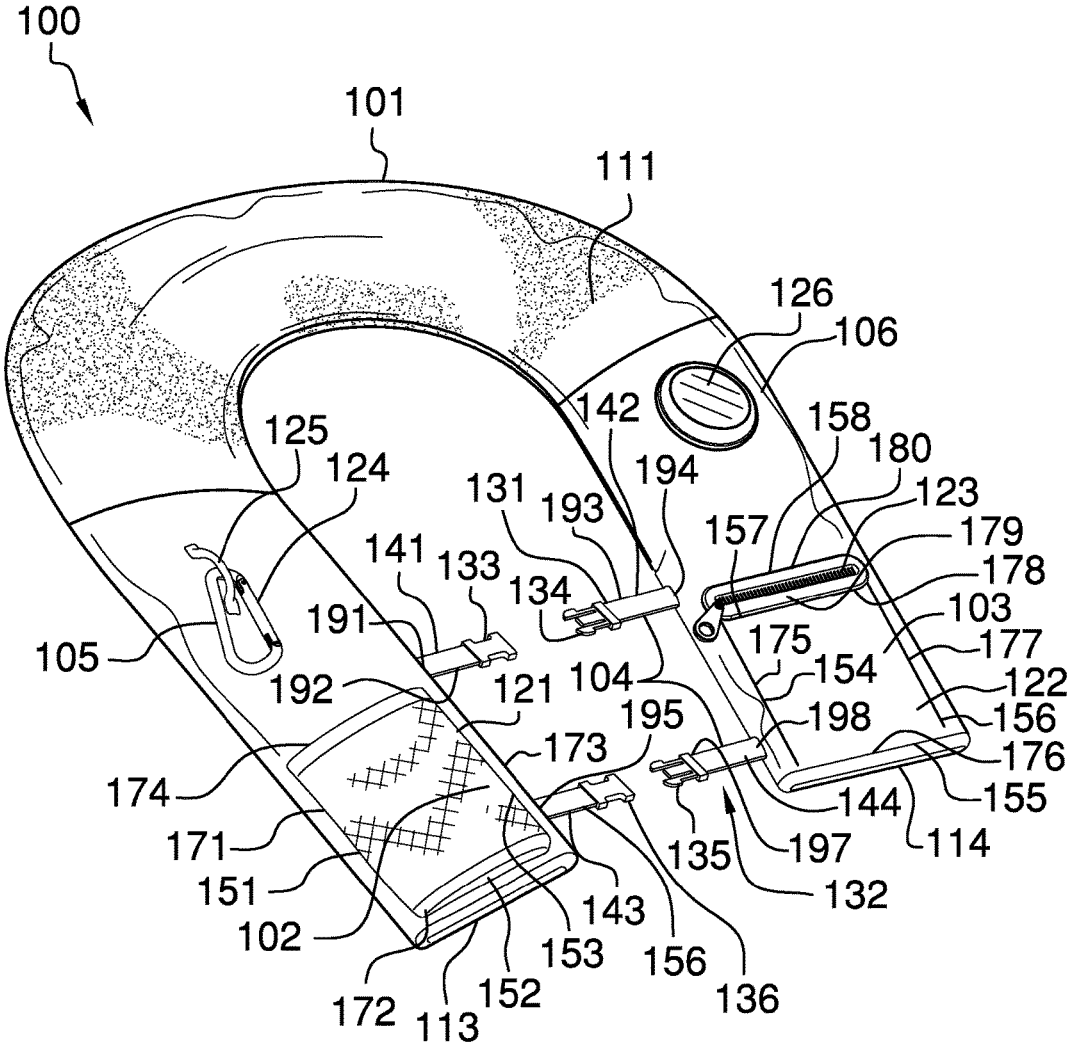
FIG. 1 is a perspective view of an embodiment of the disclosure.
Figure 2:
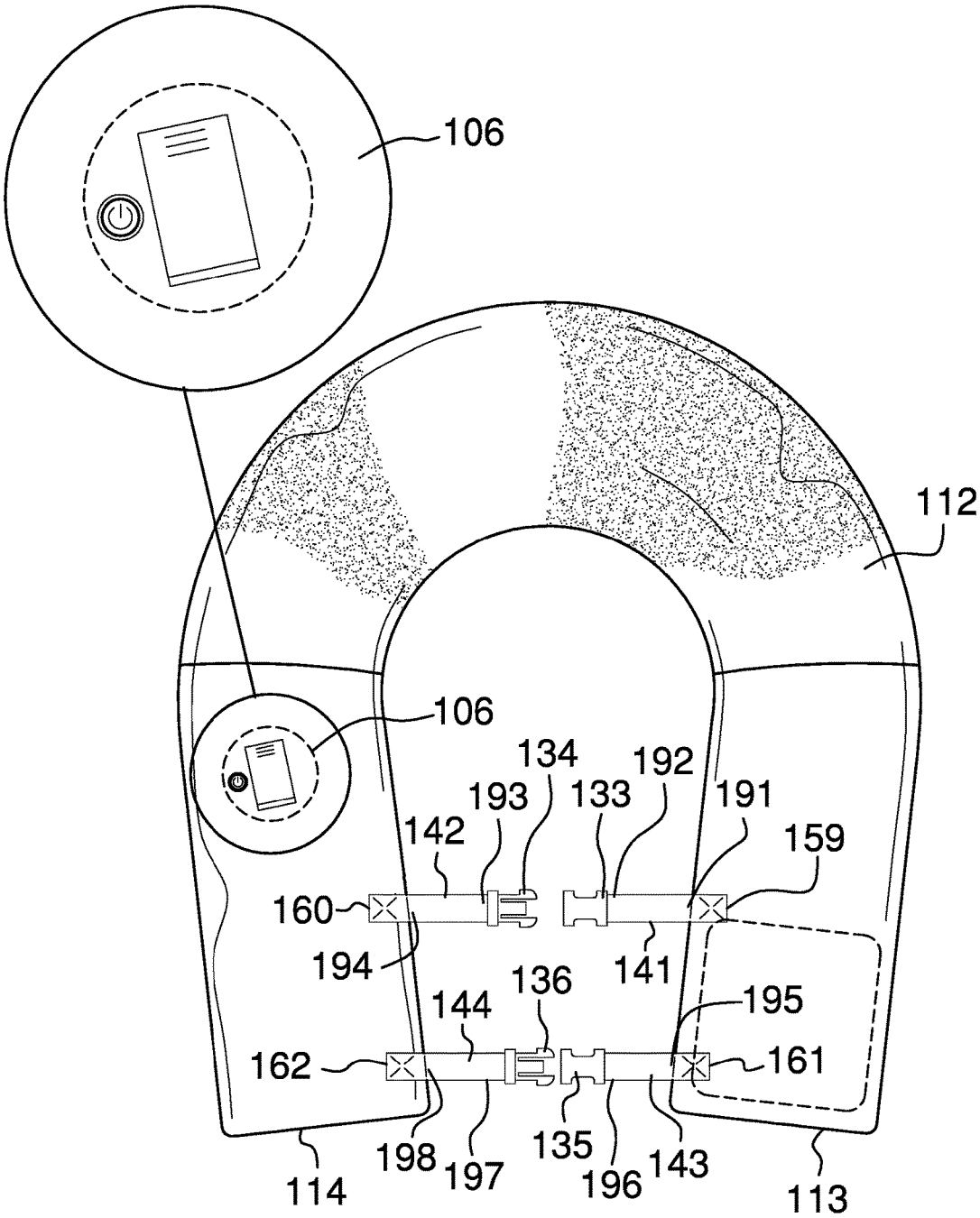
FIG. 2 is a rear view of an embodiment of the disclosure.
Figure 3:
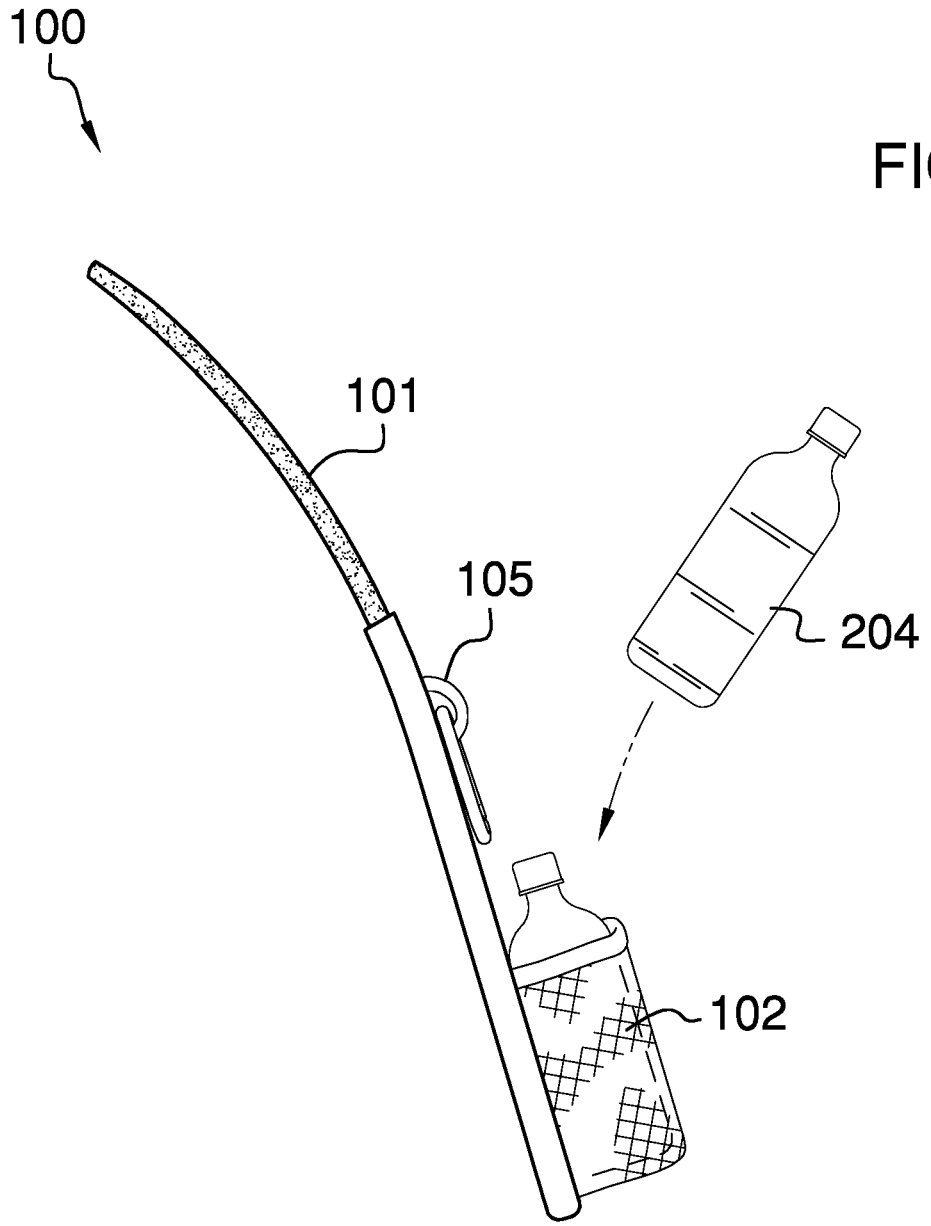
FIG. 3 is a side view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 4.

The neck wrap towel 100 (hereinafter invention) is a garment. The invention 100 is worn around the neck 202 of a person 201. When worn normally, the invention 100 drapes over the anterior 203 side of the person 201. The invention 100 is further fitted with a plurality of findings that are configured for use in travel or sporting activities. The invention 100 comprises a primary textile 101, a bottle pocket 102, a secure pocket 103, one or more fasteners 104, a loop and clip combination 105, and a light 106. The bottle pocket 102, a secure pocket 103, the one or more fasteners 104, the loop and clip combination 105, and the light 106 are attached to the primary textile 101.

Figure 4:
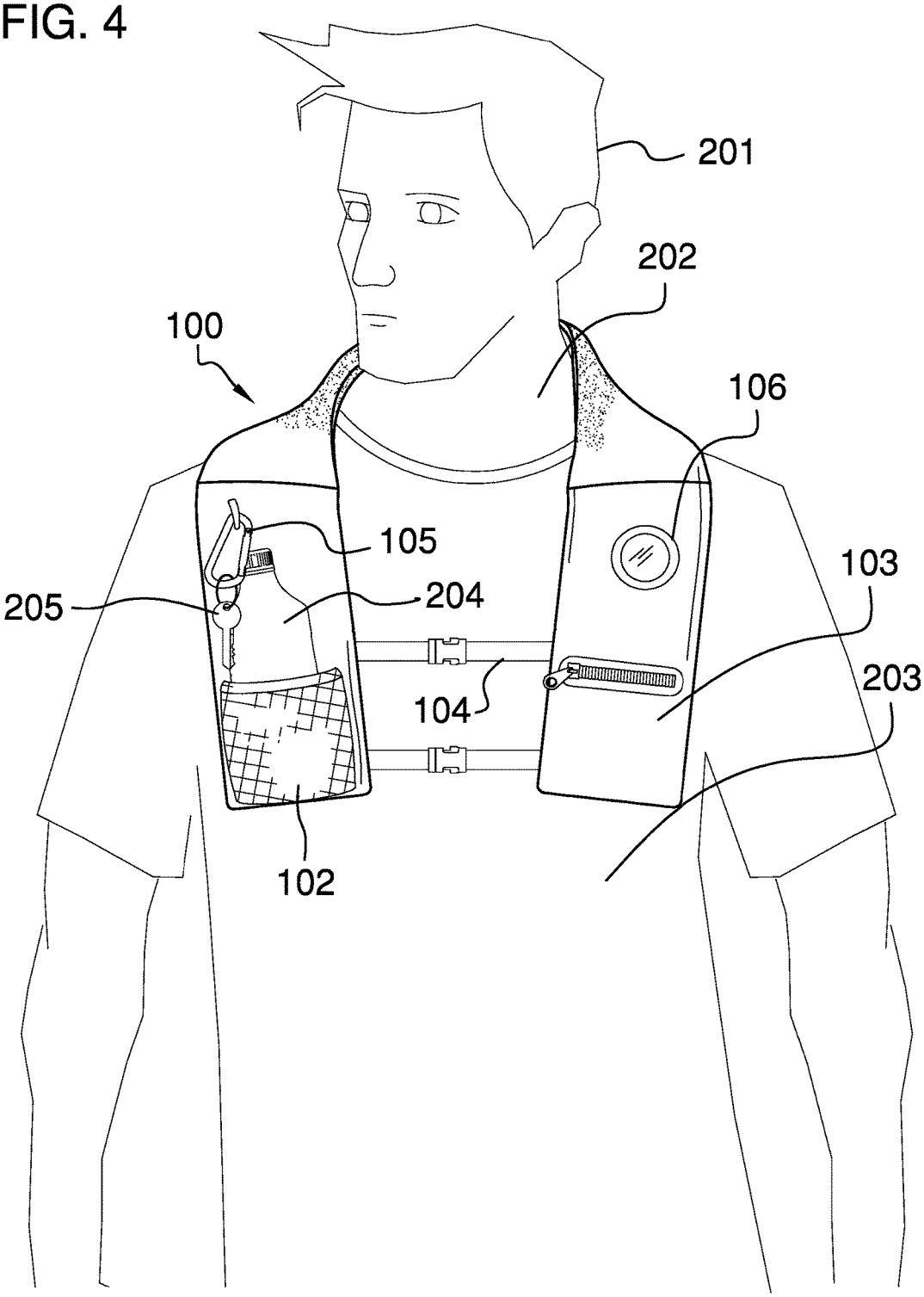
FIG. 4 is an in use view of an embodiment of the disclosure.

The primary textile 101 is a readily and commercially available textile that is cut into a rectangular shape such that the primary textile 101 will drape around the neck 202 in a U shaped fashion as shown most clearly in FIG. 4. The primary textile 101 is formed from a water wicking material such that the primary textile 101 can be used as a towel. It is preferred that the primary textile 101 be formed from a textile material selected from the group consisting of a terry fabric or a microfiber fabric. The primary textile 101 is further defined with a first surface 111, a second surface 112, a first tail 113, and a second tail 114. The first tail 113 of the primary textile 101 is the narrow edge of the primary textile 101 that: 1) hangs freely from the neck 202; and 2) is proximal to the bottle pocket 102. The second tail 114 of the primary textile 101 is the end of the primary textile 101 that is distal from the first tail 113. The first surface 111 is the side of the primary textile 101 that is distal from the body of the person 201 during normal use of the invention 100. The second surface 112 is the surface of the primary textile 101 that is distal from the first surface 111.

The bottle pocket 102 is a pocket that is attached to the primary textile 101. The bottle pocket 102 is configured to store a bottle 204 containing a beverage or other liquid. The bottle pocket 102 attaches to the first surface 111 of the primary textile 101 in a position that is proximal to the first tail 113 of the primary textile 101. The bottle pocket 102 comprises a mesh elastic textile 121. The mesh elastic textile 121 is further defined with a first edge 171, a second edge 172, a third edge 173, and a fourth edge 174.

The mesh elastic textile 121 is a readily and commercially available elastic string net mesh that is formed with elastic yarns. The mesh elastic textile 121 will expand around a bottle 204 placed within the bottle pocket 102. When the mesh elastic textile 121 returns to its relaxed shape, the elastic yarns in the mesh elastic textile 121 will secure the bottle 204 from shifting within the bottle pocket 102. As described elsewhere in this disclosure, the mesh elastic textile 121 is attached to the first surface 111 of the primary textile 101 to form the bottle pocket 102.

The secure pocket 103 is a pocket that is attached to the primary textile 101. The secure pocket 103 is configured to securely store one or more domestic articles 205. The secure pocket 103 attaches to the first surface 111 of the primary textile 101 in a position that is proximal to the second tail 114 of the primary textile 101. The secure pocket 103 comprises a rectangular textile 122 and a zipper 123. The rectangular textile 122 is further defined with a fifth edge 175, a sixth edge 176, a seventh edge 177, and an eighth edge 178. The zipper 123 is further defined with a ninth edge 179 and a tenth edge 180.

The rectangular textile 122 is a readily and commercially available textile that is cut into a rectangular shape. As described elsewhere in this disclosure, the rectangular textile 122 is attached to the first surface 111 of the primary textile 101 to form the secure pocket 103. The zipper 123 is a readily and commercially fastener that is used to open and close the secure pocket 103. The use of a zipper 123 to secure a pocket is well known and documented in the textile and apparel arts.

Each of the one or more fasteners 104 is a fastener that is used to secure the primary textile 101 around the neck 202 of the person 201 wearing the invention 100. In the first potential embodiment of the disclosure, the one or more fasteners 104 comprises a first fastener and a second fastener. In the first potential embodiment of the disclosure, the first fastener is a first quick release buckle 131 and the second fastener is a second quick release buckle 132.

The first quick release buckle 131 comprises a first female connector 133, a first male connector 134, a first webbing 141, and a second webbing 142. The first quick release buckle 131 is a readily and commercially available fastener. The first female connector 133 is the female connector associated with the first quick release buckle 131. The first male connector 134 is the male connector associated with the first quick release buckle 131. The first webbing 141 is a readily and commercially available webbing. The second webbing 142 is a readily and commercially available webbing. The first webbing 141 is further defined with a first end 191 and a second end 192. The second webbing 142 is further defined with a third end 193 and a fourth end 194.

The second quick release buckle 132 comprises a second female connector 135, a second male connector 136, a third webbing 143, and a fourth webbing 144. The second quick release buckle 132 is a readily and commercially available fastener. The second female connector 135 is the female connector associated with the second quick release buckle 132. The second male connector 136 is the male connector associated with the second quick release buckle 132. The third webbing 143 is a readily and commercially available webbing. The fourth webbing 144 is a readily and commercially available webbing. The third webbing 143 is further defined with a fifth end 195 and a sixth end 196. The fourth webbing 144 is further defined with a seventh end 197 and an eighth end 198.

The loop and clip combination 105 is an apparatus that is used to clip one or more domestic articles 205 to the first surface 111 of the primary textile 101 in a readily accessible manner. The loop and clip combination 105 comprises a carabiner and a ring 125. The carabiner 124 is a readily and commercially available coupling link that is used to removably attach one or more domestic articles 205 to the first surface 111 of the primary textile 101. The ring 125 is a readily and commercially available loop structure, often marketed as a "D" ring that is attached to the first surface 111 of the primary textile 101. Methods to attach rings to textiles are well known and documented in the textile and apparel arts.

The light 106 is a safety apparatus. The light 106 is a device that provides illumination for the purposes of: 1) improving the visibility of the person 201 in low light situations; and 2) illuminating the immediate vicinity around the person 201. The light 106 is installed on the primary textile 101 such that illumination from the light 106 is from the first surface 111 while maintenance access for the light 106 is available from the second surface 112. In the first potential embodiment of the disclosure, the light 106 is a type of flashlight that is commonly marketed as a running safety light 126. Running safety lights 126 are readily and commercially available products.

The invention 100 is assembled as described in this paragraph and the following 4 paragraphs. The invention 100 is assembled with a first seam 151, a second seam 152, a third seam 153, a fourth seam 154, a fifth seam 155, a sixth seam 156, a seventh seam 157, an eighth seam 158, a ninth seam 159, a tenth seam 160, an eleventh seam 161, a twelfth seam 162.

The first female connector 133 attaches to the second end 192 of the first webbing 141. The first male connector 134 attaches to the third end 193 of the second webbing 142. The second female connector 135 attaches to the sixth end 196 of the third webbing 143. The second male connector 136 attaches to the seventh end 197 of the fourth webbing 144. Methods to attach quick release buckles to webbings are well known and documented in the apparel arts.

The fourth edge 174 of the rectangular textile 122 is not attached to the first surface 111 of the primary textile 101 such that access can be gained to the bottle pocket 102. The fourth edge 174 of the rectangular textile 122 is positioned such that the fourth edge 174 of the second edge 172 faces the center of the primary textile 101. The eighth edge 178 of the rectangular textile 122 is positioned such that the fifth edge 175 of the rectangular textile 122 faces the center of the primary textile 101.

The first seam 151 attaches the first edge 171 of the mesh elastic textile 121 to the first surface 111 of the primary textile 101. The second seam 152 attaches the second edge 172 of the mesh elastic textile 121 to the first surface 111 of the primary textile 101. The third seam 153 attaches the third edge of the mesh elastic textile 121 to the first surface 111 of the primary textile 101. The fourth seam 154 attaches the fifth edge 175 of the rectangular textile 122 to the first surface 111 of the primary textile 101. The fifth seam 155 attaches the sixth edge 176 of the rectangular textile 122 to the first surface 111 of the primary textile 101. The sixth seam 156 attaches the seventh edge 177 of the rectangular textile 122 to the first surface 111 of the primary textile 101. The zipper 123 attaches the eighth edge 178 of the rectangular textile 122 to the first surface 111 of the primary textile 101. The seventh seam 157 attaches the ninth edge 179 of the zipper 123 to the first surface 111 of the primary textile 101. The eighth seam 158 attaches the tenth edge 180 of the zipper 123 to the eighth edge 178 of the rectangular textile 122. The ninth seam attaches the first end 191 of the first webbing 141 to the second surface 112 of the primary textile 101. The tenth seam 160 attaches the fourth end 194 of the second webbing 142 to the second surface 112 of the primary textile 101. The eleventh seam 161 attaches the fifth end 195 of the third webbing 143 to the second surface 112 of the primary textile 101. The twelfth seam 162 attaches the eighth end 198 of the fourth webbing 144 to the second surface 112 of the primary textile 101.

In the first potential embodiment of the disclosure, the first seam 151, the second seam 152, the third seam 153, the fourth seam 154, the fifth seam 155, the sixth seam 156, the seventh seam 157, the eighth seam 158, the ninth seam 159, the tenth seam 160, the eleventh seam, and the twelfth seam 162 are sewn seams.

The following definitions were used in this disclosure:

Bottle: As used in this disclosure, a bottle is a container used for the storage of fluids. Access to the interior of a bottle is gained through the neck of the bottle. The neck is an elongated tube that forms an aperture through which fluids can be introduced and removed from the bottle.

Buckle: As used in this disclosure, a buckle is a fastening that is used for joining a first loose end of a strap to a second loose end of the same strap or a different strap. A buckle further comprises a male connector that is attached to a first loose end and a female connector that is attached to a second loose end. The male connector has a pin or other structure that is generally caught by a structure formed in the female connector.

Carabiner: As used in this disclosure, a carabiner is coupling link that is usually formed as an oblong metal ring with one spring hinged side that is used to open and close the ring. Synonyms for carabiner include D-link.

Domestic Article: As used in this disclosure, a domestic article is an item or object: 1) that is commonly found within a household; or, 2) that is commonly carried by a person. Examples of domestic articles include, but are not limited to, keys and key fobs, personal data devices, glasses, remote controls, or personal storage items such as purses, briefcases, wallets, or cases.

Elastic: As used in this disclosure, an elastic is a material or object that deforms when a force is applied to it and that is able to return to its original shape after the force is removed. A material that exhibits these qualities is also referred to as an elastomeric material.

Elastic Yarn: As used in this disclosure, an elastic yarn is a yarn formed from elastomeric materials.

Fastener: As used in this disclosure, a fastener is a device that is used to join or affix two objects. Fasteners generally comprise a first element which is attached to the first object and a second element which is attached to the second object such that the first element and the second element join to affix the first object and the second object. Common fasteners include, but are not limited to, zippers, snaps, buttons, buckles, quick release buckles, or hook and loop fasteners.

Findings: As used in this disclosure, findings are small decorative elements, fasteners, or tools for fit, function, or adjustment that are used with apparel or footwear.

Loop: As used in this disclosure, a loop is the length of a first linear structure including, but not limited to, lines, cords, or ribbons, that is: 1) folded over and joined at the ends forming an enclosed space; or, 2) curved to form a closed or nearly closed space within the first linear structure. In both cases, the space formed within the first linear structure is such that a second linear structure such as a line, cord or a hook can be inserted through the space formed within the first linear structure. Within this disclosure, the first linear structure is said to be looped around the second linear structure.

Mesh: As used in this disclosure, the term mesh refers to an openwork fabric made from threads, yarns, cords, wires, or lines that are woven, knotted, or otherwise twisted or intertwined at regular intervals. Synonyms for mesh include net.

Microfiber Yarn: As used in this disclosure, a yarn is said to be a microfiber yarn when the average number of filaments or fibers contained in a cross-section of the yarn is greater than the denier of the yarn. Stated differently, a microfiber yarn is a yarn made from fibers or filaments with an average fineness, as measured by denier, of less than one denier. Please note: This definition is similar to but differs from the definition of microfiber yarn that is generally accepted in the textile industry. This definition of is preferred in this disclosure because of the relative simplicity of the definition and because the difference between the two definitions has little commercial or practical relevance.

Microfiber Fabric: As used in this disclosure, a microfiber fabric is a fabric that is formed from microfiber yarns.

Pocket: As used in this disclosure, a pocket is a small pouch or storage space that is formed into an object. Pockets are often formed by joining a second textile or a second sheeting to a first textile or a first sheeting, respectively, by sewing or heat sealing respectively.

Quick Release Buckle: As used in this disclosure, a quick release buckle is a specific type of buckle wherein the buckle can be readily and easily disconnected by pressing a button or pinching one of the ends of the quick release buckle. Quick release buckles are readily and commercially available.

Scarf: As used in this disclosure, a scarf is a rectangular length of fabric that is worn around the head or neck.

Seam: As used in this disclosure, a seam is a joining of: 1) a first textile to a second textile; 2) a first sheeting to a second sheeting; or, 3) a first textile to a first sheeting. Potential methods to form seams include, but are not limited to, a sewn seam, a heat bonded seam, an ultrasonically bonded seam, or a seam formed using an adhesive.

Sewn Seam: As used in this disclosure, a sewn seam a method of attaching two or more layers of textile, leather, or other material through the use of a thread, a yarn, or a cord that is repeatedly inserted and looped through the two or more layers of textile, leather, or other material.

Strip: As used in this disclosure, the term describes a long and narrow object of uniform thickness that appears thin relative to the length of the object. Strips are often rectangular in shape.

Terry Fabric: As used in this disclosure, a terry fabric is a textile that is formed with a plurality of uncut loops on both sides of the fabric. The plurality of uncut loops make a terry fabric highly water absorbent. Terry fabrics often comprise cotton yarns. Terry cloth is a synonym for terry fabric.

Textile: As used in this disclosure, a textile is a material that is woven, knitted, braided or felted. Synonyms in common usage for this definition include fabric and cloth.

Webbing: As used in this disclosure, a webbing is strong, close woven or knitted fabric that is used for straps or belting. As used in this disclosure, webbing is a fully formed material that is only cut to length for use. Webbing is not formed by cutting broader materials into strips.

Yarn: As used in this disclosure, a yarn is continuous strand of textile fibers and filaments. Yarns are generally used in the production of fabrics. For the purposes of this disclosure, this definition explicitly includes yarns formed from a single filament such as a monofilament yarn.

Zipper: As used in this disclosure, a zipper is a fastening device comprising two flexible strips with interlocking components that are opened and closed by pulling a slide along the two flexible strips.

With respect to the above description, it is to be realized that the optimum dimensional relationship for the various components of the invention described above and in FIGS. 1 through 4 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A garment comprising:

a primary textile, a bottle pocket, a secure pocket, one or more fasteners, a loop and clip combination, and a light;

wherein the bottle pocket, the secure pocket, the one or more fasteners, the loop and clip combination, and the light are attached to the primary textile;

wherein the garment is adapted to be worn around a neck of a person;

wherein when worn normally, the garment is adapted to drape over an anterior side of the person;

wherein the primary textile is textile that is cut into a rectangular shape;

wherein the primary textile is formed from a water wicking material;

wherein the primary textile is further defined with a first surface, a second surface, a first tail, and a second tail;

wherein the first tail of the primary textile is a narrow edge of the primary textile;

wherein the second tail of the primary textile is an end of the primary textile that is distal from the first tail; and wherein the second surface is the surface of the primary textile that is distal from the first surface.

2. The garment according to claim 1 wherein the bottle pocket attaches to the first surface of the primary textile in a position that is proximal to the first tail of the primary textile;

wherein the bottle pocket comprises a mesh elastic textile;

wherein the mesh elastic textile is further defined with a first edge, a second edge, a third edge, and a fourth edge; and wherein the mesh elastic textile is an elastic string net mesh that is formed with elastic yarns.

3. The garment according to claim 2 wherein the mesh elastic textile will expand around a bottle placed within the bottle pocket; and wherein when the mesh elastic textile returns to a relaxed shape, the elastic yarns in the mesh elastic textile will secure the bottle from shifting within the bottle pocket.

4. The garment according to claim 3 wherein the secure pocket is configured to securely store one or more domestic articles; and wherein the secure pocket attaches to the first surface of the primary textile in a position that is proximal to the second tail of the primary textile.

5. The garment according to claim 4 wherein the secure pocket comprises a rectangular textile and a zipper;

wherein the rectangular textile is cut into a rectangular shape;

wherein the rectangular textile is further defined with a fifth edge, a sixth edge, a seventh edge, and an eighth edge;

wherein the zipper is further defined with a ninth edge and a tenth edge;

wherein the rectangular textile is attached to the first surface; and wherein the zipper is a fastener that is used to open and close the secure pocket.

6. The garment according to claim 5 wherein each of the one or more fasteners is a fastener that is used to secure the primary textile around a neck of the person wearing the garment.

7. The garment according to claim 6 wherein the one or more fasteners comprises a first fastener and a second fastener;

wherein the first fastener is a first quick release buckle and the second fastener is a second quick release buckle;

wherein the first quick release buckle comprises a first female connector, a first male connector, a first webbing, and a second webbing;

wherein the first webbing is further defined with a first end and a second end; and wherein the second webbing is further defined with a third end and a fourth end.

8. The garment according to claim 7, wherein the loop and clip combination is an apparatus that is used to clip one or more domestic articles to the first surface of the primary textile;

wherein the loop and clip combination comprises a carabiner and a ring;

wherein the carabiner is a coupling link that is used to removably attach one or more domestic articles to the primary textile; and wherein the ring is a loop structure that is attached to the first surface of the primary textile.

9. The garment according to claim 8 wherein the light is installed on the primary textile such that illumination from the light is from the first surface while maintenance access for the light is available from the second surface.

10. The garment according to claim 9 wherein the first female connector attaches to the second end of the first webbing; and wherein the first male connector attaches to the third end of the second webbing.

11. The garment according to claim 10 wherein the fourth edge of the rectangular textile is not attached to the first surface of the primary textile such that access can be gained to the bottle pocket; and wherein the fourth edge of the rectangular textile is positioned such that the fourth edge of the second edge faces a center of the primary textile.

12. The garment according to claim 11 wherein the primary textile is formed from a textile material selected from a group consisting of a terry fabric or a microfiber fabric.

13. The garment according to claim 12 wherein the light is a running safety light.

* * * * *